US008282795B2

(12) United States Patent
Lapelosa et al.

(10) Patent No.: US 8,282,795 B2
(45) Date of Patent: Oct. 9, 2012

(54) INTEGRATED ELECTROLYTIC ACTING TORCH FOR THE SURFACE WORKING OF METALS

(75) Inventors: Michele Lapelosa, Emilia (IT); Stefano Muratori, Formigine (IT)

(73) Assignee: EDK Research AG, Zug (CH)

( * ) Notice: Subject to any disclaimer, the term of this patent is extended or adjusted under 35 U.S.C. 154(b) by 1390 days.

(21) Appl. No.: 10/576,790

(22) PCT Filed: Oct. 21, 2003

(86) PCT No.: PCT/IT03/00647

§ 371 (c)(1),
(2), (4) Date: Feb. 15, 2007

(87) PCT Pub. No.: WO2005/038096

PCT Pub. Date: Apr. 28, 2005

(65) Prior Publication Data

US 2007/0235323 A1 Oct. 11, 2007

(51) Int. Cl.
*B23H 7/00* (2006.01)

(52) U.S. Cl. ..... 204/224 M; 204/271; 204/297.14

(58) Field of Classification Search ..... 204/224 M, 204/271, 297.14

See application file for complete search history.

(56) References Cited

U.S. PATENT DOCUMENTS

| | | | | |
|---|---|---|---|---|
| 828,814 A | | 8/1906 | Cunninghamn | |
| 2,798,849 A | | 7/1957 | Lindsay | |
| 3,150,012 A | * | 9/1964 | Tanaka | 429/63 |
| 3,346,477 A | | 10/1967 | Wolfer | |
| 4,085,867 A | * | 4/1978 | Heller | 222/181.3 |
| 5,964,990 A | * | 10/1999 | Muratori et al. | 204/224 M |
| 6,158,620 A | * | 12/2000 | Polan | 222/92 |
| 6,875,539 B2 | * | 4/2005 | Ophardt | 429/127 |
| 2002/0157964 A1 | * | 10/2002 | Hoffman, Jr. et al. | 205/670 |

FOREIGN PATENT DOCUMENTS

| | | |
|---|---|---|
| CH | 130909 | 4/1929 |
| DE | 1130245 | 5/1962 |
| DE | 8513410 | 11/1985 |
| DE | 3834035 | 4/1990 |
| DE | 4018649 | 12/1991 |
| JP | 60-32367 | 3/1985 |
| JP | 63-91161 | 4/1988 |
| JP | 4-73588 | 6/1992 |

OTHER PUBLICATIONS

International Search Report dated Mar. 2, 2005.
Japanese Office Action dated Mar. 10, 2009.
Japanese Office Action dated Oct. 13, 2009 with an English translation.

* cited by examiner

*Primary Examiner* — Nicholas A. Smith
(74) *Attorney, Agent, or Firm* — McGinn IP Law Group, PLLC

(57) ABSTRACT

The torch with integrated electrolytic action for the surface treatment of metals, comprises a peak-paddle (2) connected with the unipolar electric current supply (7, 16) from an external apparatus, the other pole being connected with the metal surface being treated, and has the electrolytic solution used, for the specific treatment, arranged in a tank (6, 21) connected to said torch to supply said peak-paddle through channels inside said torch; the electrolytic solution being put under pressure in the delivery direction through a dosaging device of said solution controlled by the user. Different embodiments are described with manually actuated pumps and/or rigid or flexible tanks for spraying by the user. The tank (6, 21) is advantageously made removable, to allow the replacement of the electrolytic solution and to change the type of work to be carried out on the metallic surface in a quick and clean manner.

4 Claims, 5 Drawing Sheets

Fig. 6
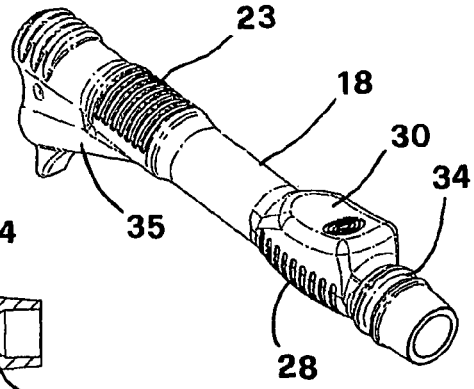
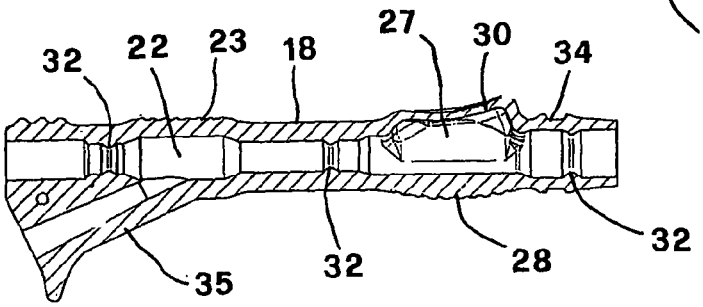
Fig. 5
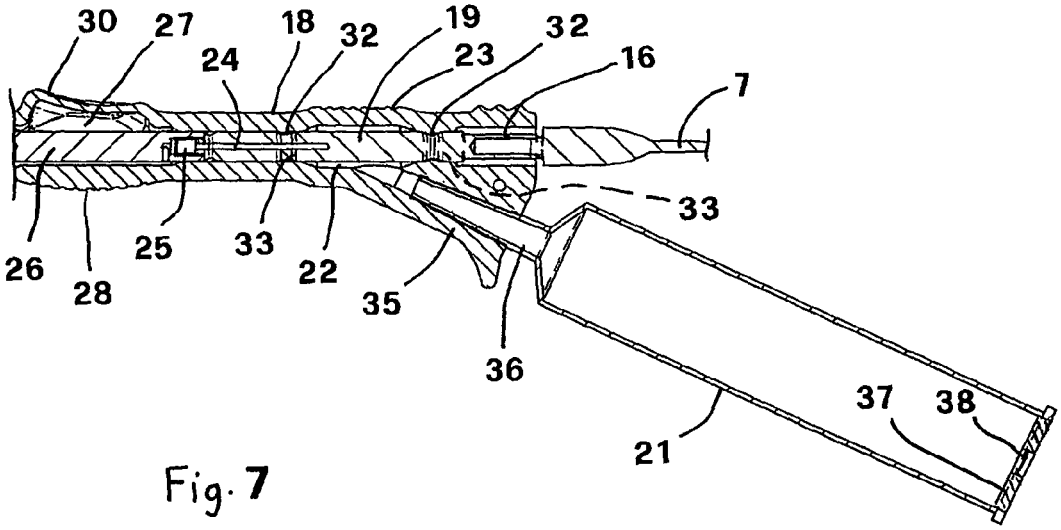
Fig. 7

INTEGRATED ELECTROLYTIC ACTING TORCH FOR THE SURFACE WORKING OF METALS

The invention concerns an integrated electrolytic acting torch for the surface working of metals, or rather a device in which a peak-paddle is brought into contact with the surface of the metal to carry out an operation of cleaning, pickling, polishing, electrodepositing or permanent writing with oxidation thereupon; with said torch integrated with the electrolytic action application device.

The state of the art comprises various types of electrolytic action devices on the surface of metals in which an electric current generating device is arranged with two conductors: one in connection with the metallic surface and the other connected to the localised action peak-paddle. Each device requires supply of the electrolytic solution with regularity in order to allow said action to be carried out.

It is known in the state of the art to dip the peak-paddle in cans of electrolytic solution at regular intervals, to keep said peak-paddle wet which is advantageously coated with a sheathing pad in porous but insulating material so as to bring the electrolytic solution into contact with the surface of the metal without allowing direct contact between the peak-paddle and said surface.

To avoid the dipping of the pad, supply devices of the electrolytic solution with a pump from a tank arranged in the central body and separated from the handle of the peak-paddle have been developed so as to constantly supply said solution and to avoid overheating of the pad that would damage it.

Therefore, known devices are somewhat bulky and suitable for high production, indeed, on them there are also suction devices for the fumes generated in said electrolytic action.

In the field it is also known to use writing instruments with electrolytic action on the surface of the metal. These devices do not have further characteristics of use for a cleaning action of the metal, but allow just writing.

Therefore, from the state of the art various actions are known with electrolytic action on the surface of the metals, but each device does not allow, for reasons of bulk, cost and practicality, both the pickling, polishing and/or cleaning action to be realised or even with a different solution, the writing and electrodepositing action.

Such state of the art is susceptible to numerous improvements with regard to the possibility of realising a device of simple construction, easy to use and of fairly low cost which allows use in the polishing and/or cleaning or even the writing and electrodepositing operations.

From this derives the need to solve the technical problem of finding a device for applying the electrolytic pickling, polishing and/or cleaning action, in an integrated manner with the same device which can also be used to carry out the writing and the electrodepositing. Last but not least said device must be of low bulk and easy to transport and, finally, must allow the easy and problem-free passage from one type of treatment to the other.

The invention solves the aforementioned technical problem by adopting: an integrated electrolytic acting torch for the surface working of metals, comprising a peak-paddle connected with the unipolar electric current supply from an external apparatus, the other pole being connected with the metal surface being treated, characterised in that it has the electrolytic solution used, for the specific treatment, arranged in a tank connected to said torch to supply said peak-paddle through channels inside said torch; the electrolytic solution is put under pressure in the delivery direction through a dosaging device of said solution controlled by the user.

Moreover, by adopting, in a further preferred embodiment, as a device for controlling the delivery of the electrolytic solution, a capillary passage, possibly with a slightly variable conical section, arranged in any point of the supply ducts and activated by pressure of the user on said tank.

Furthermore, by adopting, in a further preferred embodiment, as a device for controlling the delivery of the electrolytic solution, a sequence valve, arranged in any point of the supply ducts and activated by pressure of the user on said tank.

Moreover, by adopting, in a further preferred embodiment, as a device for controlling the delivery of the electrolytic solution, a manual pump with a mobile piston, arranged in any point of the supply ducts and activated by pressure of the user on the body or shell of said torch.

Furthermore, by adopting, in a further preferred embodiment, associated with said pump with a mobile piston, at least one non-return valve arranged in the ducts between said piston and the tank.

Moreover, by adopting, in a further preferred embodiment, as a device for controlling the delivery of the electrolytic solution, a manual pump realised with the flexibility of the shell of said torch, arranged in any point of the supply ducts.

Furthermore, by adopting, in a further preferred embodiment, associated with said pump realised with a pair of non-return valves arranged one upstream and the other downstream of said flexible zone of the shell.

Moreover, by adopting, in a further preferred embodiment, said tank of the electrolytic solution removably connected with said torch.

Furthermore, by adopting, in a further preferred embodiment, said tank in which, connected inside, there is a filter permeable just to air or a capillary for the re-entry of air after the suction of the electrolytic solution.

Moreover, by adopting, in a further preferred embodiment, said tank of the type with a semi-rigid or flexible casing for the re-entry of air after spraying worked by the user.

Furthermore, by adopting, in a further preferred embodiment, said tank of the type with a rigid casing in which inside of it there is a mobile partition with a surface in contact with atmospheric pressure for the re-entry of air after the suction of the electrolytic solution.

Moreover, by adopting, in a further preferred embodiment, said tank of the type with a rigid casing in which inside of it there is a mobile partition with a surface in contact with a pressurised chamber to push upon said partition during the delivery to push the electrolytic solution.

Furthermore, by adopting, in a further preferred embodiment, said tank of the type with a rigid casing in which inside of it there is a mobile partition equipped with a union hole for a traction and return shaft of the partition, to realise the reloading of the tank with the suction of the electrolytic solution.

Moreover, by adopting, in a further preferred embodiment, said shell of the torch shaped to realise rigidifying zones thereof and zones with concentrated flexibility.

Furthermore, by adopting, in a further preferred embodiment, the shell shaped to realise a chamber on the central metallic body downstream of the non-return valve.

Moreover, by adopting, in a further preferred embodiment, the shell shaped to realise a chamber upstream of the second no-return valve and at the most flexible zone of said shell.

Furthermore, by adopting, in a further preferred embodiment, said shell of the torch shaped to realise preferential sealing zones between the inside of the shell and the metallic body, through annular seats on said body and corresponding annular inner edges in the shell.

Finally, by adopting, in a further preferred embodiment, said shell of the torch shaped to realise preferential sealing zones between the inside of the shell and the metallic body, through annular grooves on the outside of the shell for the application of belt and locking rings of said shell.

A way of carry out the invention is illustrated, purely as an example, in the five attached tables of drawings, in which:

FIG. 5 is a longitudinal section of the shell in insulating and flexible plastic material of the torch of FIG. 3;

FIG. 6 is a perspective view of the shell in insulating and flexible plastic material of the torch of FIG. 5;

FIG. 7 is a longitudinal section of the body of the torch of FIG. 3 and thereafter to highlight the internal configuration thereof;

Figure 2:
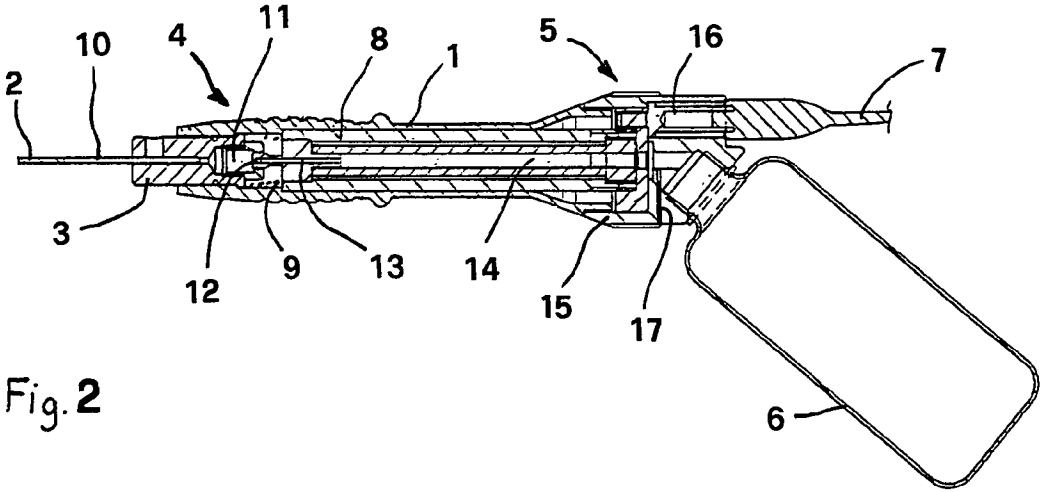
FIG. 2 is a longitudinal section of the torch of FIG. 1.
Figure 1:
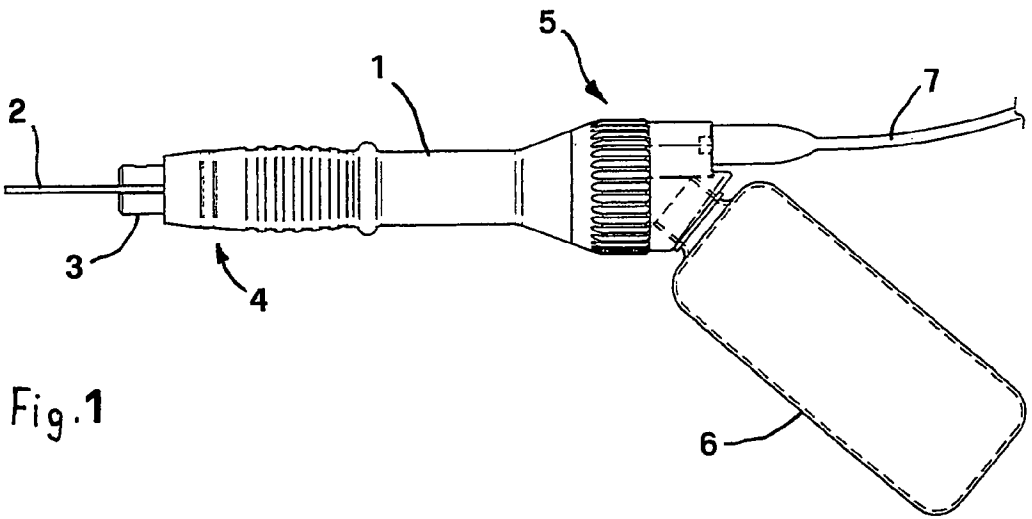
FIG. 1 is a side view of the torch for the application of the electrolytic action on the surface of the metals according to a first version of the present invention.

In FIGS. 1 and 2, to represent a first embodiment of the invention, it is possible to see the body 1 of the torch from which the peak-paddle 2 projects, for the electrolytic action on the metallic surface, applied to the piston 3 which can slide in the front part 4 of said body. In the rear part 5, the rigid or semi-rigid tank 6 for supplying the appropriate electrolytic solution and the supply cable 7 from the electrical generator, not shown, are applied to the body. In the body 1 there is a metal sleeve 8, advantageously made from acid-resistant stainless steel, for the union between the electric cable 7 and the piston 3, for which electrical continuity is ensured by the counter spring 9 of the piston 3, both in acid-resistant stainless steel. Said peak-paddle is equipped with a longitudinal cut 10 for the sliding of the electrolytic solution on the peak-paddle 2 and in the pad, not shown. The solution present in the tank 6 is sucked by the movement of said piston 3 following the pressing of the peak-paddle 2 against the metallic surface. Indeed, the back and forth motion of the piston leads to the reduction in volume of the chamber 11 with the consequent push of the solution in the cut 10. A non-return valve 12 is present at the end of a duct 13 present axially to the sleeve 8 and in connection to an axial hole 14 thereof directly connected to said tank 6 through the head 15 of said rear part 5. The head is equipped with a unipolar union 16 for the electrical cable 7, which electrically connects said cable with said sleeve 8; moreover, a capillary hole 17 on said head 15 allows the re-entry of air into the tank 6, as the electrolytic solution is dispensed.

Figure 3:
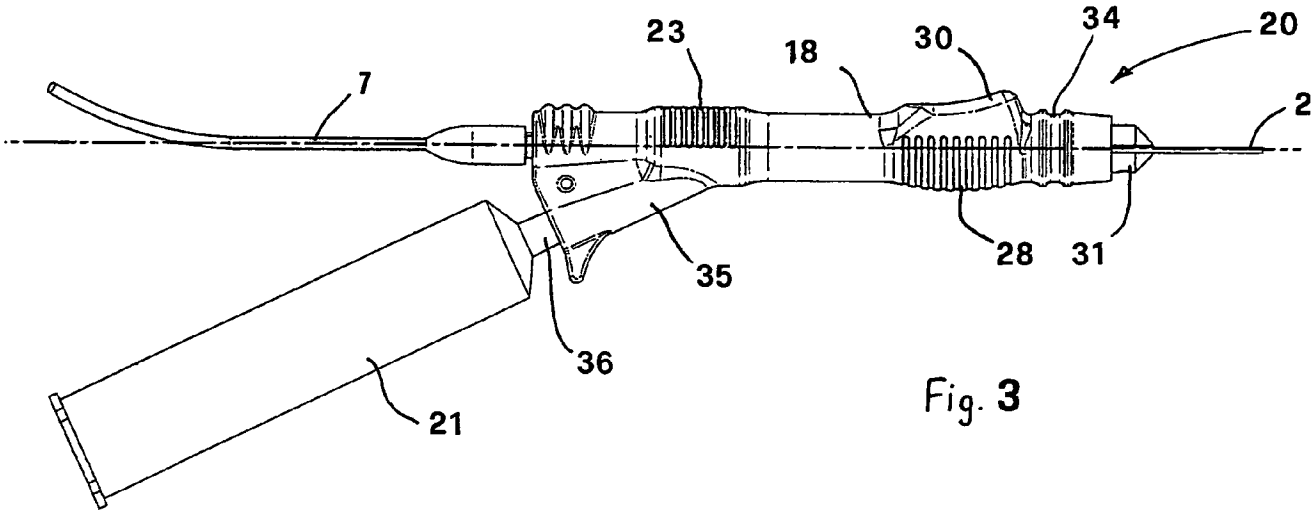
FIG. 3 is a side view of a second embodiment of the torch for applying the electrolytic action according to the invention.
Figure 4:
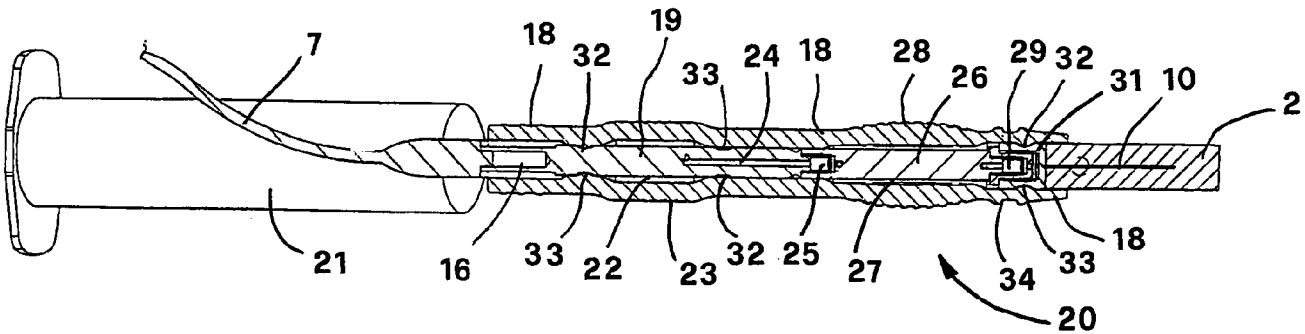
FIG. 4 is a plan longitudinal section of the torch of FIG. 3.

In FIGS. 3 and 4, to represent a second embodiment of the invention, it is possible to see the shell 18 in insulating and flexible coating material for the axial body 19 of the torch 20 to which the tank 21 is connected which releases the electrolytic solution into the first chamber 22 at the rear widening 23 of said shell. The body 19, in the front part, has an axial hole 24 connected to said first chamber 22 and ending with a first non-return valve 25; axially to the body 19 there is a forepart 26 at a second chamber 27 and at the front widening 28 of said shell 18; said forepart is radially perforated at the two ends, the rear immediately downstream of said first non-return valve 25 and the front immediately upstream of a second non-return valve 29, for the passage to and from said two non-return valves from the second chamber 27.

Said second chamber 27 has a more flexible zone 30 of the shell 18 to increase the volume of said chamber 27, to realise the variability of volume of said chamber in order to obtain the push of the electrolytic solution coming out from said second non-return valve 29, after which the peak-paddle 2 is locked with the clamp 31. To realise a good seal on said two chambers 22 and 27 the shell and the body, the forepart and the clamp have annular seats 32 in which inner edges 33 of said shell 18 engage. Moreover, at the clamp 31 the shell has an outer annular groove 34, for the insertion of a locking ring to complete the seal. The shell has the appendix 35 for the introduction of the delivery tube 36 from the tank 21. Said tube 36 is directly connected to said first chamber 22. Advantageously, the body 19, the forepart 26 and the clamp 31 are in acid-resistant stainless steel.

Figure 8:
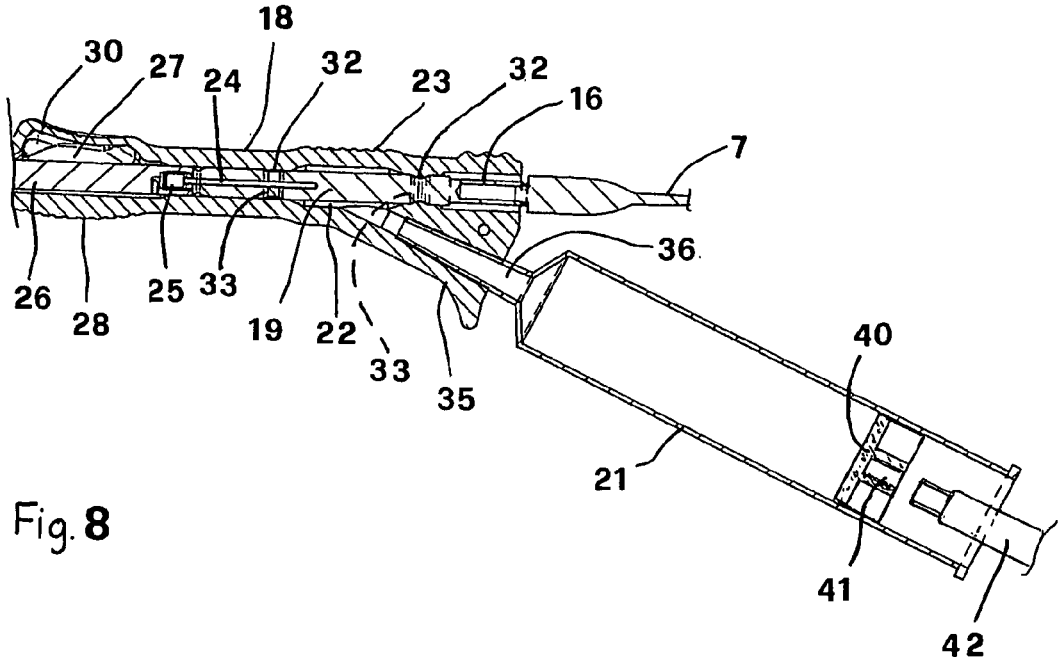
FIGS. 8 and 9 are section views analogous to FIG. 7 but with different supply tanks of the electrolytic solution to the torch.
Figure 9:
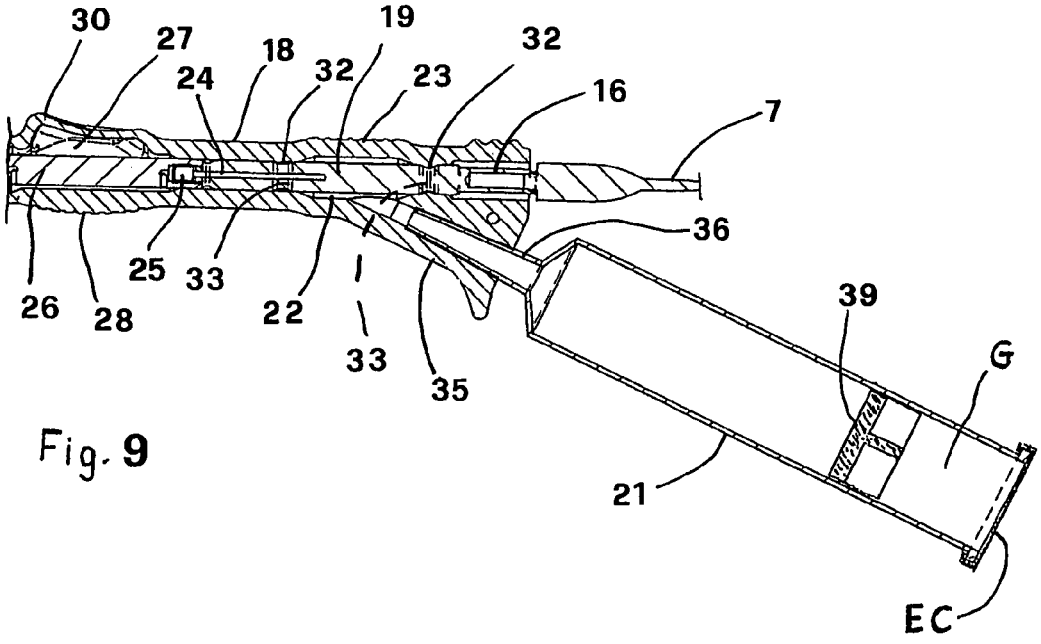

In FIGS. 7, 8 and 9 it is possible to see different ways of realising said tank 21. Thus, in FIG. 7 said tank is closed on one side by a rigid end wall 37 on which a textile membrane filter 38 is arranged for just the re-entry of air, necessary during the delivery of the electrolytic solution; whereas in FIGS. 8 and 9 it is possible to see a mobile partition 39, or 40 when equipped with a hole 41 for the union of a shaft end 42 for the return of said partition: said operation, when carried out with the tube 36 immersed, allows the suction of the electrolytic solution into the tank 21 from a container of greater capacity, so as to reuse the tank many times over.

In the case of the partition 39 it is also possible to apply a cover EC to the end of the tank and to introduce pressurised gas into the chamber G so as to obtain the push of the electrolytic solution independently from the pumping action carried out in any case. In this case the piston 3 or the more flexible zone 30 of the chamber 27 shall function like simple taps.

Figure 10:
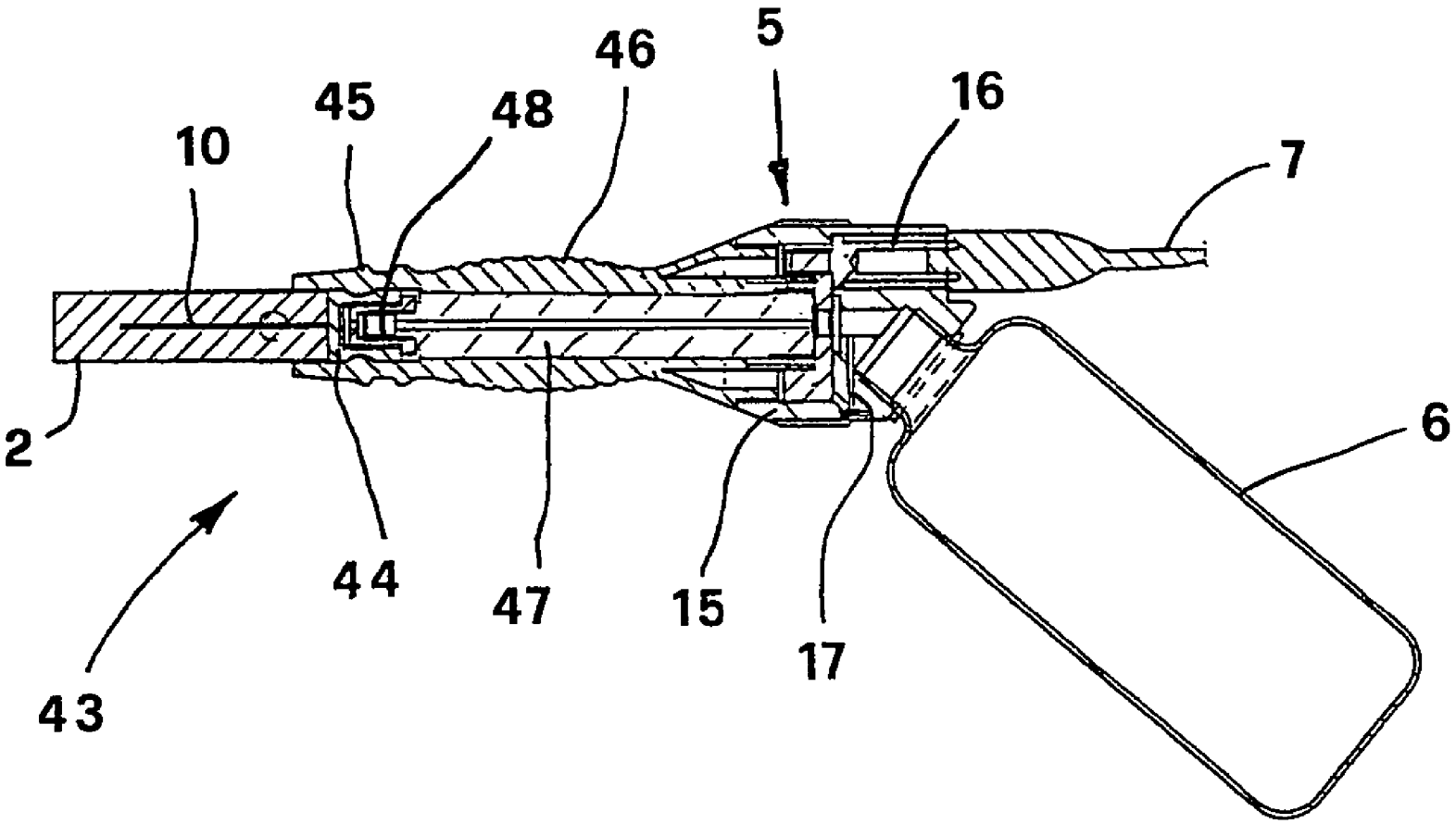
FIG. 10 is a section view of a simplified version of the torch according to the invention.

Finally, in FIG. 10 a further embodiment of the invention is represented, in which the simplified torch 43 has the peak-paddle 2 locked to the clamp 44 held in the front end 45 of the insulating shell 46. Inside the shell there is a perforated body 47 for connection with the head 15, to which the unipolar union 16 and the tank 6 are applied. Advantageously, the perforated body 47 and the clamp 44 are made from acid-resistant stainless steel. Said body allows the supply of the electrolytic solution to a sequence valve 48 for the dosaging of said solution. By pressing against the tank 6 the liquid is pushed through the sequence valve which, having reached a calculated pressure, allows the passage of said solution in the cut 10 and onto the peak-paddle 2. The capillary 17 then allows the re-entry of air into said tank 6. To replace the sequence valve 48 it is possible to use a capillary hole of suitable section for the passage of the electrolytic solution.

The advantages obtained by this invention are: the combination of the torch and the tank connected to it allow the secure distribution of the electrolytic solution; moreover, the passage from one type of treatment to another with a different electrolytic solution is made much easier, the replacement of the tank with the corresponding electrolytic solution and a brief washing of the chambers and/or holes of the torch, amongst other things having a small volume, being necessary; therefore, it is extremely versatile and easy to equip in the change of treatment; indeed, at the end of the pickling treatment the user is not left with contaminated electrolytic solution for dipping the peak-paddle with the pad. Furthermore, the delivery of the electrolytic solution in the version with a pump, of FIGS. 1 and 2 or of FIGS. 3 to 9, allows precise delivery without dripping, as well as delivery under the head. Finally, the various forms of supply tanks of the electrolytic solution allow the realisation of disposable tanks or the realisation of reloadable or re-usable tanks with immediate reloading.

In practical use the materials, the sizes and the details can be different from those indicated, but technically equivalent to them, without for this reason departing from the legal domain of the present invention. Thus, even if less advantageous, for the complications brought to the constructive simplicity of the forms of torch described, a unipolar switch integrated in the head and in the torch itself can be associated with the unipolar electric circuit, which crosses said torch in any of the embodiments, to interrupt the working current, without having to act directly upon on-switches for the electrical source separate from the torch.

The invention claimed is:

1. A torch with integrated electrolytic action for the surface treatment of metals, comprising:

a peak-paddle connected with the unipolar electric current supply from an external apparatus, the other pole being connected with the metal surface being treated, in which an electrolytic solution used for the treatment is arranged in a tank connected to said torch to supply said peak-paddle through channels inside said torch, and the electrolytic solution is put under pressure in a delivery direction through a metering device of said solution controlled by the user;

wherein said torch comprises as a device for controlling a delivery of the electrolytic solution, a manual pump realized with a flexible zone of a shell of said torch, arranged in on any part of supply ducts, said pump comprising a first non-return valve arranged upstream and a second non-return valve arranged downstream of said flexible zone of the shell, wherein said shell comprises a handgrip shaped to include rigidifying zones and zones with concentrated flexibility, wherein said shell is shaped to include a chamber at the second non-return valve and at the flexible zone of said shell, wherein the shell is shaped to include preferential sealing zones between an inside of the shell and a metallic body, through annular seats on the metallic body and corresponding annular edges in the shell, to form a seal on said chamber, wherein the metallic body includes an axial bole connected to said chamber and ending at the first non-return valve, and wherein said tank is removably connected to said torch and comprises a semi-rigid or flexible casing for re-entry of air after spraying or suction of the electrolytic solution worked by a user.

2. The torch according to claim 1, wherein said tank comprises, connected with the inside thereof, a filter permeable just to air or a capillary for the re-entry of air after the spraying or suction of the electrolytic solution.

3. A torch with integrated electrolytic action for the surface treatment of metals, comprising:

a peak-paddle connected with the unipolar electric current supply from an external apparatus, the other pole being connected with the metal surface being treated, in which an electrolytic solution used for the treatment is arranged in a tank connected to said torch to supply said peak-paddle through channels inside said torch, and the electrolytic solution is put under pressure in a delivery direction through a metering device of said solution controlled by the user;

wherein said torch comprises as a device for controlling a delivery of the electrolytic solution, a manual pump realized with a flexible zone of a shell of said torch, arranged in on any part of supply ducts, said pump comprising a first non-return valve arranged upstream and a second non-return valve arranged downstream of said flexible zone of the shell wherein said shell comprises a handgrip shaped to include rigidifying zones and zones with concentrated flexibility, wherein said shell is shaped to include a chamber at the second non-return valve and at the flexible zone of said shell, wherein said shell is shaped to include preferential sealing zones between an inside of the shell and a metallic body, through annular grooves on an outside of the shell with an application of a belt and locking rings of the shell on the chamber, wherein the metallic body includes an axial hole connected to said chamber and ending at said first non-return valve, and wherein said tank is removably connected to said torch and comprises a semi-rigid or flexible casing for re-entry of air after spraying or suction of the electrolytic solution worked by a user.

4. The torch according to claim 3, wherein said tank comprises, connected with the inside thereof, a filter permeable just to air or a capillary for the re-entry of air after the suction of the electrolytic solution.

* * * * *